US006994425B2

(12) United States Patent
Silverbrook

(10) Patent No.: US 6,994,425 B2
(45) Date of Patent: Feb. 7, 2006

(54) INK JET PRINTHEAD THAT INCLUDES TILT-COMPENSATING INK EJECTION PORTS

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 315 days.

(21) Appl. No.: 10/893,378

(22) Filed: Jul. 19, 2004

(65) Prior Publication Data

US 2004/0257405 A1 Dec. 23, 2004

Related U.S. Application Data

(63) Continuation of application No. 10/303,347, filed on Nov. 23, 2002, now Pat. No. 6,767,077.

(51) Int. Cl.
*B41J 2/04* (2006.01)

(52) U.S. Cl. ..... 347/56
(58) Field of Classification Search ..... 347/56
See application file for complete search history.

(56) References Cited

U.S. PATENT DOCUMENTS

| | | | | |
|---|---|---|---|---|
| 4,967,209 | A | 10/1990 | Hasegawa et al. | |
| 6,027,205 | A | 2/2000 | Herbert | |
| 6,299,289 | B1 | 10/2001 | Silverbrook | |
| 6,299,290 | B1 | 10/2001 | Silverbrook | |
| 6,505,916 | B1 | 1/2003 | Silverbrook | |
| 2002/0075347 | A1 | 6/2002 | Sharma et al. | |
| 2004/0085402 | A1 * | 5/2004 | Silverbrook | 347/54 |

FOREIGN PATENT DOCUMENTS

| | | |
|---|---|---|
| JP | 096758 | 4/2001 |
| JP | 2001096758 A | 4/2001 |
| WO | WO 99/03680 A | 1/1999 |
| WO | WO 99/03680 | 1/1999 |

* cited by examiner

*Primary Examiner*—Raquel Gordon

(57) ABSTRACT

An ink jet printhead includes a substrate. A plurality of micro-electromechanical nozzle arrangements is positioned on the substrate. Each nozzle arrangement includes a nozzle chamber defining structure positioned on the substrate. The structure has a fixed portion that is fast with the substrate and a movable portion that is displaceable with respect to the substrate and that defines an ink ejection port. The movable portion and fixed portion together define a nozzle chamber and the movable portion is displaceable towards and away from the substrate to reduce and subsequently increase a volume of the nozzle chamber so that ink is ejected from the ink ejection port. An elongate actuator is anchored to the substrate at one end and operatively engaged with the movable portion at an opposite end. The elongate actuator is bent relative to the substrate on receipt of an electrical signal to displace the movable portion with respect to the fixed portion. The ink ejection port is shaped so that tilting of the movable portion results in the ejection of a drop of ink in a direction substantially at right angles to the substrate.

6 Claims, 11 Drawing Sheets

INK JET PRINTHEAD THAT INCLUDES TILT-COMPENSATING INK EJECTION PORTS

Continuation application on Ser. No. 10/303,347 filed on Nov. 23, 2002 now U.S. Pat. No. 6,767,077.

FIELD OF THE INVENTION

This invention relates to an ink jet printhead. More particularly, the invention relates to an ink jet printhead that includes tilt-compensating ink ejection ports.

BACKGROUND TO THE INVENTION

Ink jet printheads of the type manufactured using micro-electromechanical systems technology have been proposed in a construction using nozzle chambers formed in layers on the top of a substrate with nozzle chambers formed in the layers. Each chamber is provided with a movable paddle actuated by some form of actuator to force ink in a drop through the nozzle associated with the chamber upon receipt of an electrical signal to the actuator. Such a construction is typified by the disclosure in International Patent Application PCT/AU99/00894 to the Applicant.

The present invention stems from the realisation that there are advantages to be gained by dispensing with the paddles and causing ink drops to be forced from the nozzle by decreasing the size of the nozzle chamber. It has been realised that this can be achieved by causing the actuator to move the nozzle itself downwardly in the chamber thus dispensing with the paddle, simplifying construction and providing an environment which is less prone to the leakage of ink from the nozzle chamber.

Furthermore, Applicant has identified that it would be useful to incorporate a mechanism whereby ink ejection ports could be kept clear of obstructions, such as dried ink or paper dust.

SUMMARY OF THE INVENTION

According to a first aspect of the invention, there is provided an ink jet printhead that comprises a substrate; and a plurality of micro-electromechanical nozzle arrangements positioned on the substrate, each nozzle arrangement comprising a nozzle chamber defining structure positioned on the substrate and having a fixed portion that is fast with the substrate and a movable portion that is displaceable with respect to the substrate and that defines an ink ejection port, the movable portion and fixed portion together defining a nozzle chamber and the movable portion being displaceable towards and away from the substrate to reduce and subsequently increase a volume of the nozzle chamber so that ink is ejected from the ink ejection port; and an elongate actuator that is anchored to the substrate at one end and operatively engaged with the movable portion at an opposite end, the elongate actuator being bent relative to the substrate on receipt of an electrical signal to displace the movable portion with respect to the fixed portion, wherein the ink ejection port is shaped so that tilting of the movable portion results in the ejection of a drop of ink in a direction substantially at right angles to the substrate.

The ink ejection port may be defined by a nozzle rim which has a suitable plan profile to impart said shape to the ink ejection port.

The nozzle rim may be shaped to define a first side which is flatter and broader than an opposite second side, the first side being interposed between the second side and the actuator, such that surface tension effects across the ink ejection port are greater at the second side than at the first side.

The movable portion may include a roof wall and a sidewall depending from a periphery of the roof wall. The fixed portion may include a complementary sidewall. The sidewalls may be configured to overlap when the movable portion is displaced towards the substrate.

The substrate may define a plurality of ink inlet channels. Each ink inlet channel may be in fluid communication with a respective nozzle chamber.

Flow restriction members may be positioned in an opening of each inlet conduit to restrict the flow of ink into the nozzle chamber, thereby to facilitate pressure development in the nozzle chamber as the movable portion is displaced towards the substrate.

According to a second aspect of the invention there is provided an ink jet printhead that comprises a substrate; and a plurality of micro-electromechanical nozzle arrangements positioned on the substrate, each nozzle arrangement comprising a nozzle chamber defining structure having a fixed portion that is fast with the substrate and a movable portion that is displaceable with respect to the substrate and that defines an ink ejection port, the movable portion and fixed portion together defining a nozzle chamber and the movable portion being displaceable towards and away from the substrate to reduce and subsequently increase a volume of the nozzle chamber so that ink is ejected from the ink ejection port; and an actuator that is operatively engaged with the movable portion to displace the movable portion with respect to the fixed portion, wherein a projection is positioned on the substrate, the projection being configured so that, when the movable portion is displaced towards the substrate, the projection extends through the ink ejection port.

The substrate may define a plurality of ink conduits, each ink conduit being in fluid communication with a respective nozzle chamber.

The movable portion may include a roof portion and a sidewall depending from a periphery of the roof wall. The fixed portion may include a complementary sidewall, the sidewalls being configured to overlap when the movable portion is displaced towards the substrate.

Each projection may be in the form of a rod-like structure. Each rod-like structure may be mounted on a respective bridge member that spans each ink conduit.

BRIEF DESCRIPTION OF THE DRAWINGS

Notwithstanding any other forms that may fall within its scope, one preferred form of the invention will now be described by way of example only with reference to the accompanying drawings in which.

DETAILED DESCRIPTION OF THE DRAWINGS

It will be appreciated that a large number of similar nozzles are simultaneously manufactured using MEMS and CMOS technology as described in our co-pending patent applications referred to at the beginning of this specification.

For the purposes of clarity, the construction of an individual ink jet nozzle arrangement will now be described.

Whereas in conventional ink jet construction of the type described in our above referenced co-pending patent applications, ink is ejected from a nozzle chamber by the movement of a paddle within the chamber, according to the present invention the paddle is dispensed with and ink is ejected through an ink ejection port in a movable portion of a nozzle chamber defining structure, which is moved downwardly by a bend actuator, decreasing a volume of the nozzle chamber and causing ink to be ejected from the ink ejection port.

Throughout this specification, the relative terms "upper" and "lower" and similar terms are used with reference to the accompanying drawings and are to be understood to be not in any way restrictive on the orientation of the nozzle arrangement in use.

Figure 1:
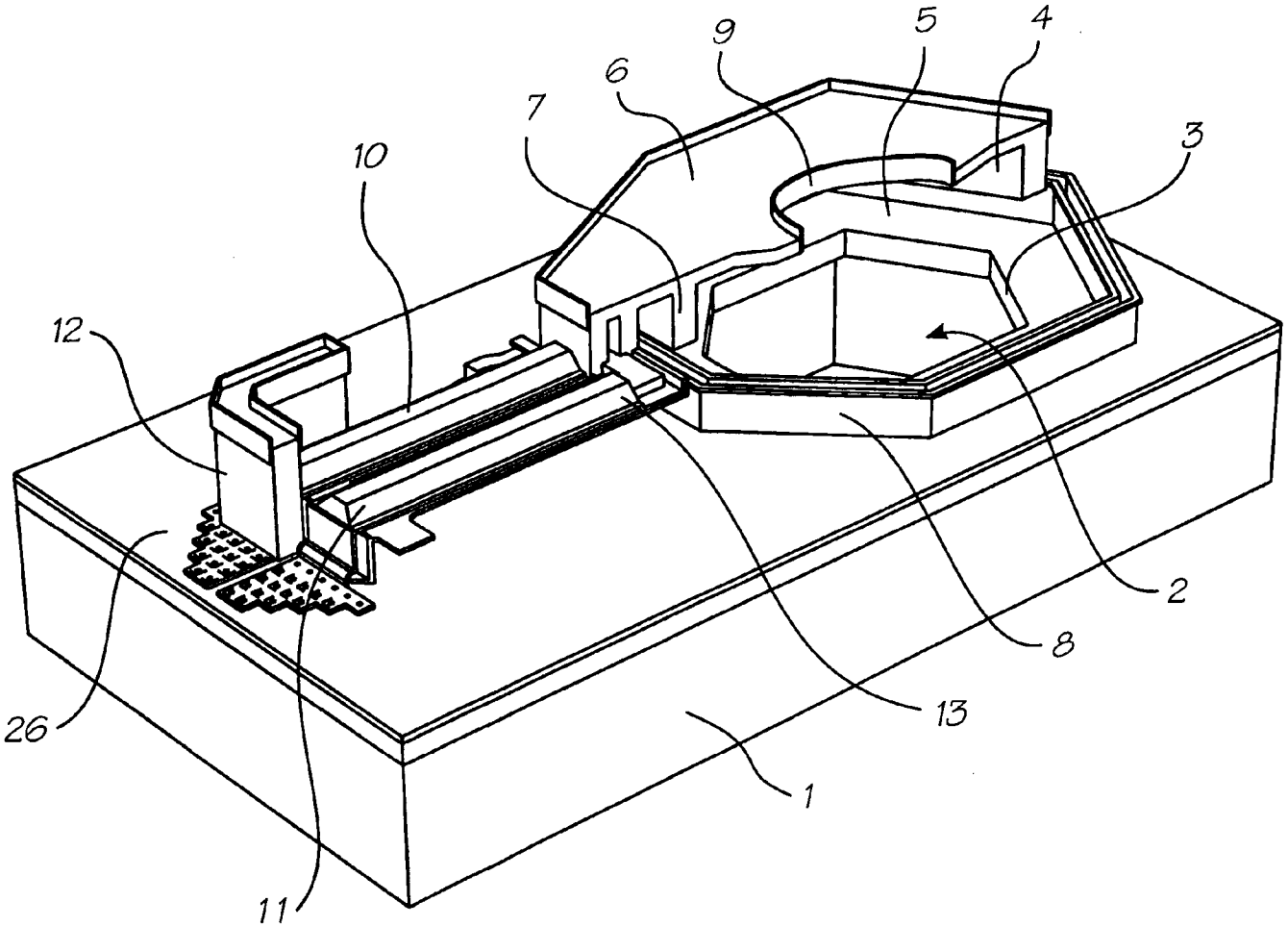
FIG. 1 is a partially cutaway perspective view of a nozzle arrangement of a printhead of the invention.
Figure 2:
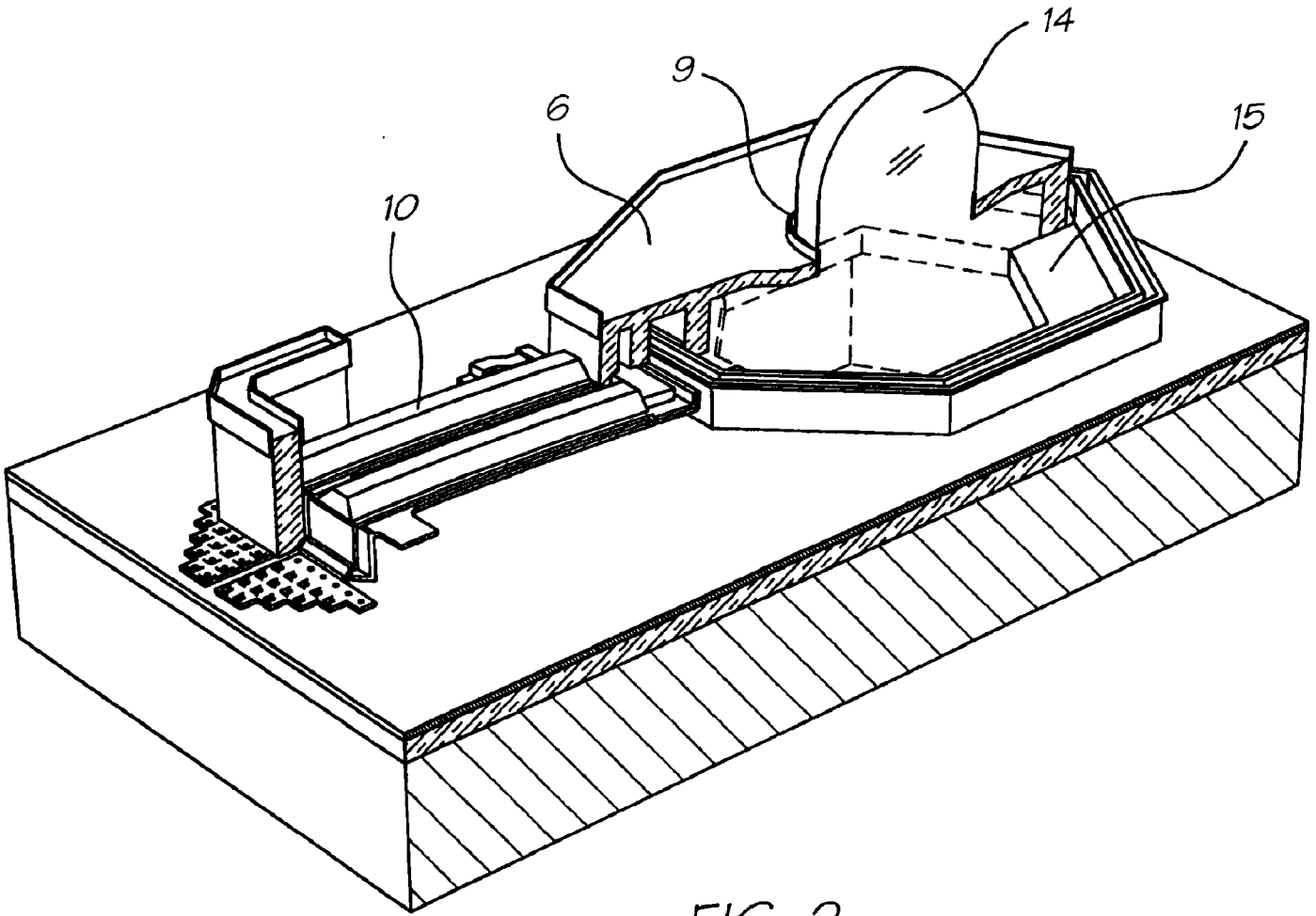
FIG. 2 is a similar view to FIG. 1 showing the bend actuator of the nozzle arrangement bent causing a drop of ink to protrude from an ink ejection port of the nozzle arrangement.
Figure 3:
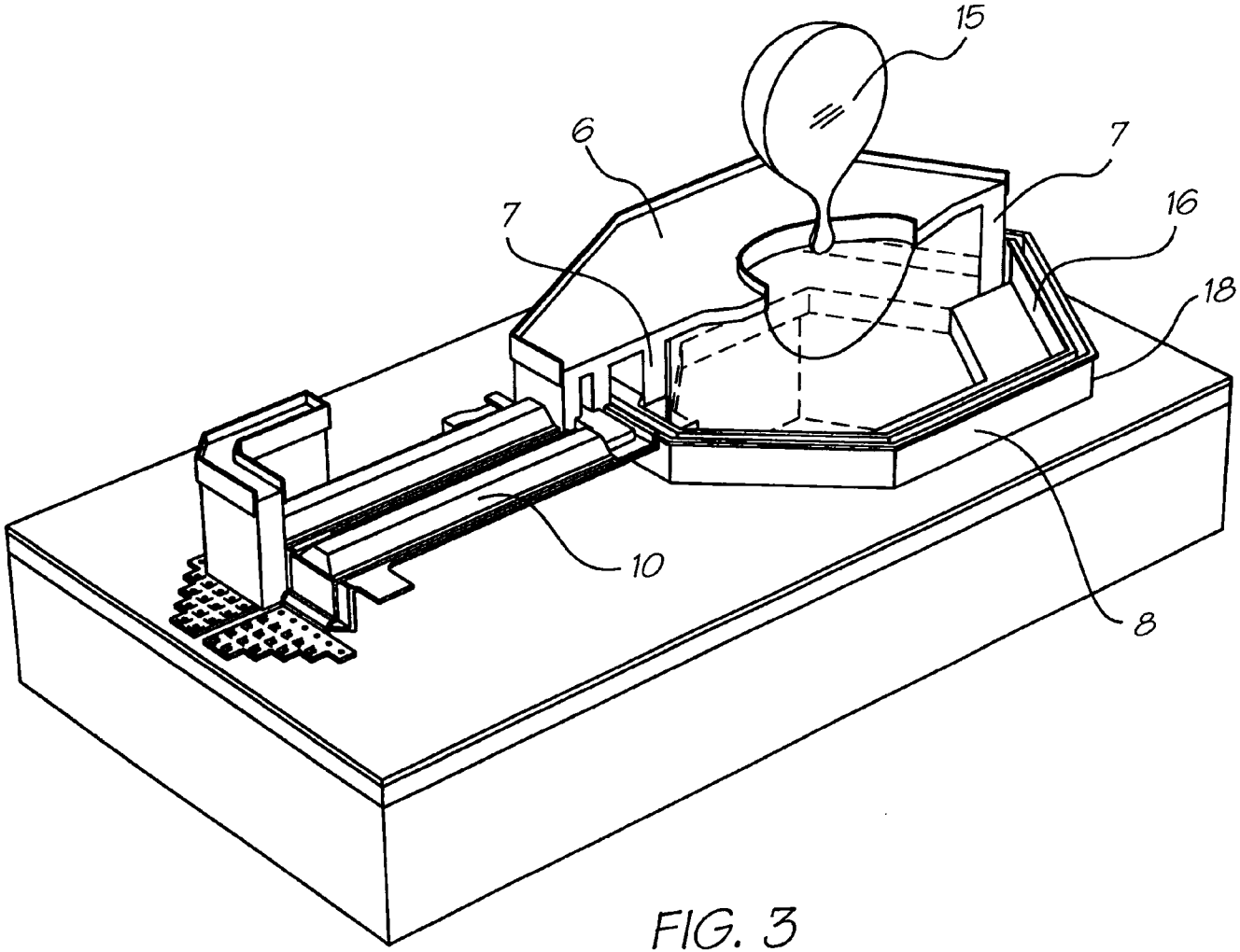
FIG. 3 is a similar view to FIG. 1 showing the nozzle arrangement returned to a quiescent condition and the drop of ink ejected from the nozzle.

Referring now to FIGS. 1 to 3 of the accompanying drawings, the nozzle arrangement is constructed on a substrate 1 by way of MEMS technology defining an ink supply conduit 2 opening through a hexagonal opening 3 (which could be of any other suitable configuration) into a nozzle chamber 4 defined by floor portion 5, roof portion 6 and peripheral sidewalls 7 and 8 which overlap in a telescopic manner. The sidewalls 7, depending downwardly from roof portion 6, are sized to be able to move upwardly and downwardly within sidewalls 8 which depend upwardly from floor portion 5.

An ejection port is defined by rim 9 located in the roof portion 6 so as to define an opening for the ejection of ink from the nozzle chamber as will be described further below.

The roof portion 6 and downwardly depending sidewalls 7 are supported by a bend actuator 10 typically made up of layers forming a heated cantilever which is constrained by a non-heated cantilever, so that heating of the heated cantilever causes a differential expansion between the heated cantilever and the non-heated cantilever causing the bend actuator 10 to bend as a result of thermal expansion of the heated cantilever.

A proximal end 11 of the bend actuator 10 is fastened to the substrate 1, and prevented from moving backwards by an anchor member 12 which will be described further below, and the distal end 13 is secured to, and supports, the roof portion 6 and sidewalls 7 of the nozzle arrangement.

In use, ink is supplied to the nozzle chamber through conduit 2 and opening 3 in any suitable manner, but typically as described in our previously referenced co-pending patent applications. When it is desired to eject a drop of ink from the nozzle chamber, an electric current is supplied to the bend actuator 10 causing the actuator to bend to the position shown in FIG. 2 and to move the roof portion 6 downwardly toward the floor portion 5. This relative movement decreases the volume of the nozzle chamber, causing ink to bulge upwardly from the nozzle rim 9 as shown at 14 (FIG. 2) where it forms a droplet by the surface tension in the ink.

When the electric current is cut off, the actuator 10 reverts to the straight configuration as shown in FIG. 3 moving the roof portion 6 of the nozzle chamber upwardly to the original location. The momentum of the partially formed ink droplet 14 causes the droplet to continue to move upwardly forming an ink drop 15 as shown in FIG. 3 which is projected on to the adjacent paper surface or other article to be printed.

In one form of the invention, the opening 3 in floor portion 5 is relatively large compared with the cross-section of the nozzle chamber and the ink droplet is caused to be ejected through the nozzle rim 9 upon downward movement of the roof portion 6 by viscous drag in the sidewalls of the aperture 2, and in the supply conduits leading from the ink reservoir (not shown) to the opening 2. This is a distinction from many previous forms of ink jet nozzles where the "back pressure" in the nozzle chamber which causes the ink to be ejected through the nozzle rim upon actuation, is caused by one or more baffles in the immediate location of the nozzle chamber. This type of construction can be used with a moving nozzle ink jet of the type described above, and will be further described below with specific reference to FIGS. 9 and 10, but in the form of invention shown in FIGS. 1 to 3, the back pressure is formed primarily by viscous drag and ink inertia in the supply conduit.

Figure 4:
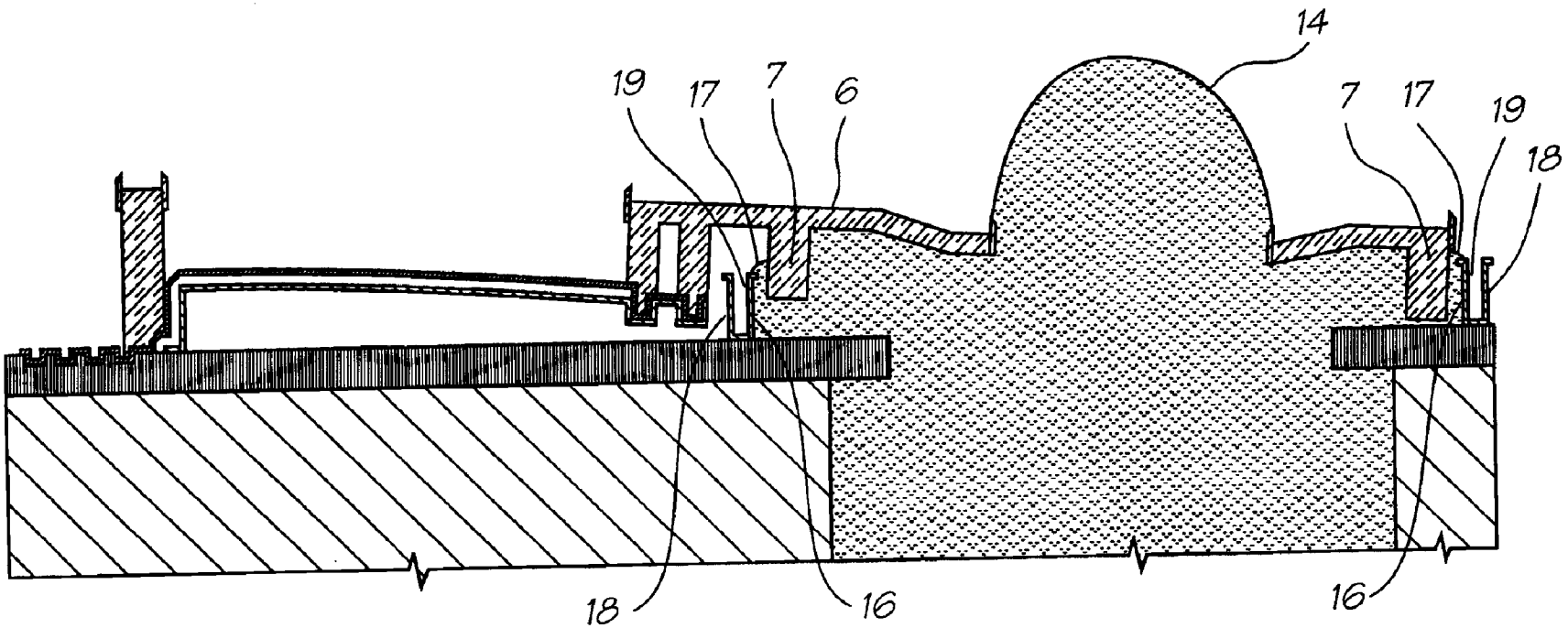
FIG. 4 is a cross-sectional view through a mid line of the nozzle arrangement as shown in FIG. 2.

In order to prevent ink leaking from the nozzle chamber during actuation i.e. during bending of the bend actuator 10, a fluidic seal is formed between sidewalls 7 and 8 as will now be further described with specific reference to FIGS. 3 and 4.

The ink is retained in the nozzle chamber during relative movement of the roof portion 6 and floor portion 5 by the geometric features of the sidewalls 7 and 8 which ensure that ink is retained within the nozzle chamber by surface tension. To this end, there is provided a very fine gap between downwardly depending sidewall 7 and the mutually facing surface 16 of the upwardly depending sidewall 8. As can be clearly seen in FIG. 4, the ink (shown as a dark shaded area) is restrained within a small aperture between the downwardly depending sidewall 7 and inward faces 16 of the upwardly extending sidewall 8. The small aperture is defined by the proximity of the two sidewalls, which ensures that the ink "self seals" across free opening 17 by surface tension.

In order to make provision for any ink which may escape the surface tension restraint due to impurities or other factors which may break the surface tension, the upwardly depending sidewall 8 is provided in the form of an upwardly facing channel having not only the inner surface 16 but a spaced apart parallel outer surface 18 forming a U-shaped channel 19 between the two surfaces. Any ink drops escaping from the surface tension between the surfaces 7 and 16, overflows into the U-shaped channel where it is retained rather than "wicking" across the surface of the nozzle strata. In this manner, a dual wall fluidic seal is formed which is effective in retaining the ink within the moving nozzle mechanism.

As has been previously described in some of our co-pending applications, it is desirable in some situations to clear any impurities which may build up within the nozzle opening and ensure clean and clear ejection of a droplet from the nozzle under actuation. A configuration of the present invention using a projection in combination with a moving nozzle ink jet is shown in the accompanying FIGS. 5, 6 and 7.

Figure 5:
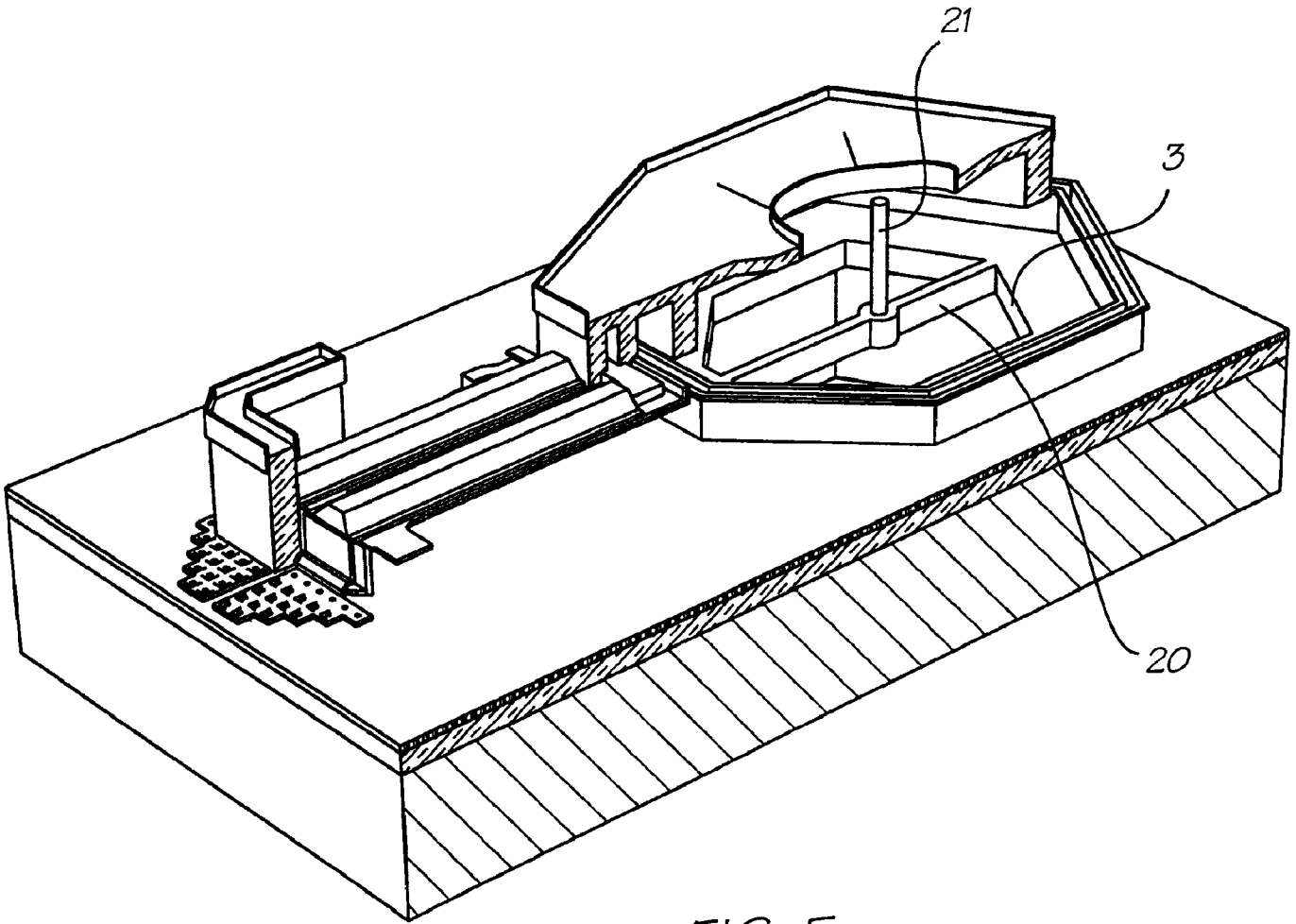
FIG. 5 is a similar view to FIG. 1 showing the use of a projection to clear the ink ejection port.

FIG. 5 is similar to FIG. 1 with the addition of a bridge member or bridge 20 across the opening 3 in the floor of the nozzle chamber, on which is mounted an upwardly extending rod-like structure or rod 21 sized to protrude into and/or through the plane of the ink ejection port during actuation.

Figure 6:
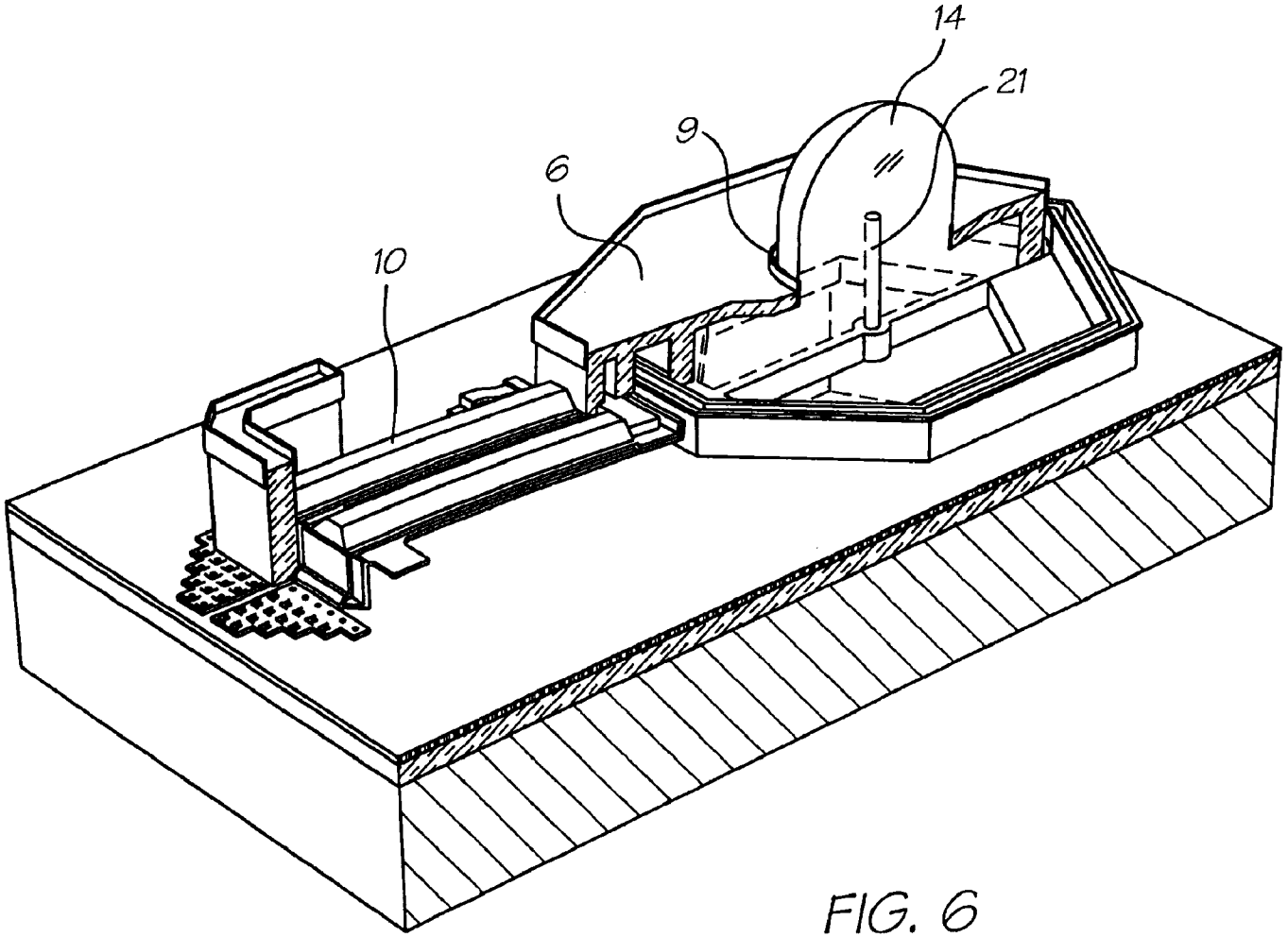
FIG. 6 is a similar view to FIG. 5 showing the bend actuator bent and a drop of ink protruding from the nozzle arrangement.

As can be seen in FIG. 6, when the roof portion 6 is moved downwardly by bending of the bend actuator 10, the rod 21 is caused to extend up through the ink ejection port defined by the nozzle rim 9 and partly into the bulging ink drop 14.

Figure 7:
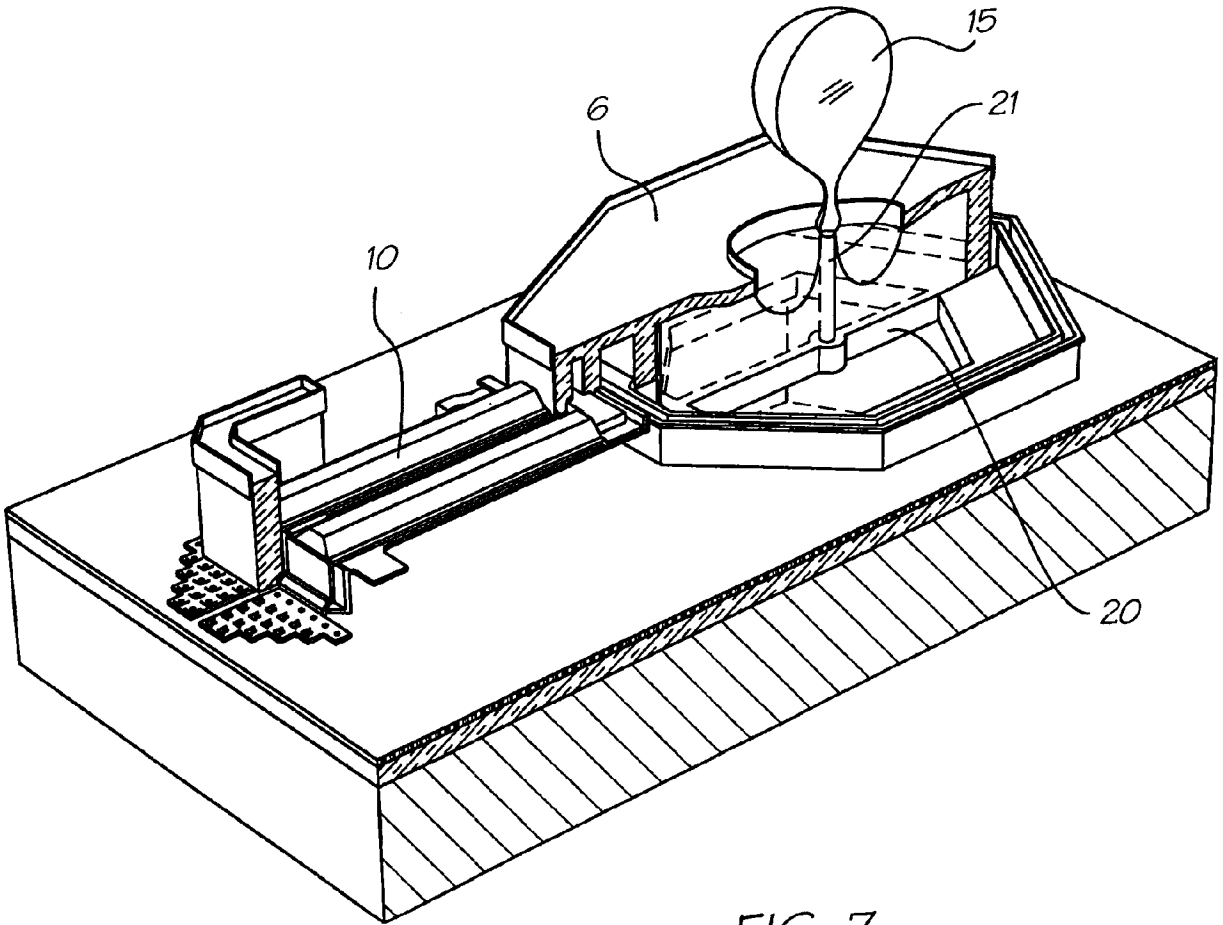
FIG. 7 is a similar view to FIG. 5 showing the bend actuator straightened and the drop of ink being ejected from the nozzle arrangement.

As the roof portion 6 returns to its original position upon straightening of the bend actuator 10 as shown in FIG. 7 the ink droplet is formed and ejected as previously described and the poker 21 is effective in dislodging or breaking any dried ink which may form across the nozzle rim 9 and which would otherwise block the ink ejection port.

It will be appreciated that as the bend actuator 10 is bent causing the roof portion to move downwardly to the position shown in FIG. 2, the roof portion tilts relative to the floor portion 5 causing the nozzle to move into an orientation which is not parallel to the surface to be printed, at the point of formation of the ink droplet. This orientation, if not corrected, would cause the ink droplet 15 to be ejected from the nozzle in a direction which is not quite perpendicular to the plane of the floor portion 5 and to the strata of nozzles in general. This would result in inaccuracies in printing, particularly as some nozzles may be oriented in one direction and other nozzles in a different, typically opposite, direction.

Figure 8:
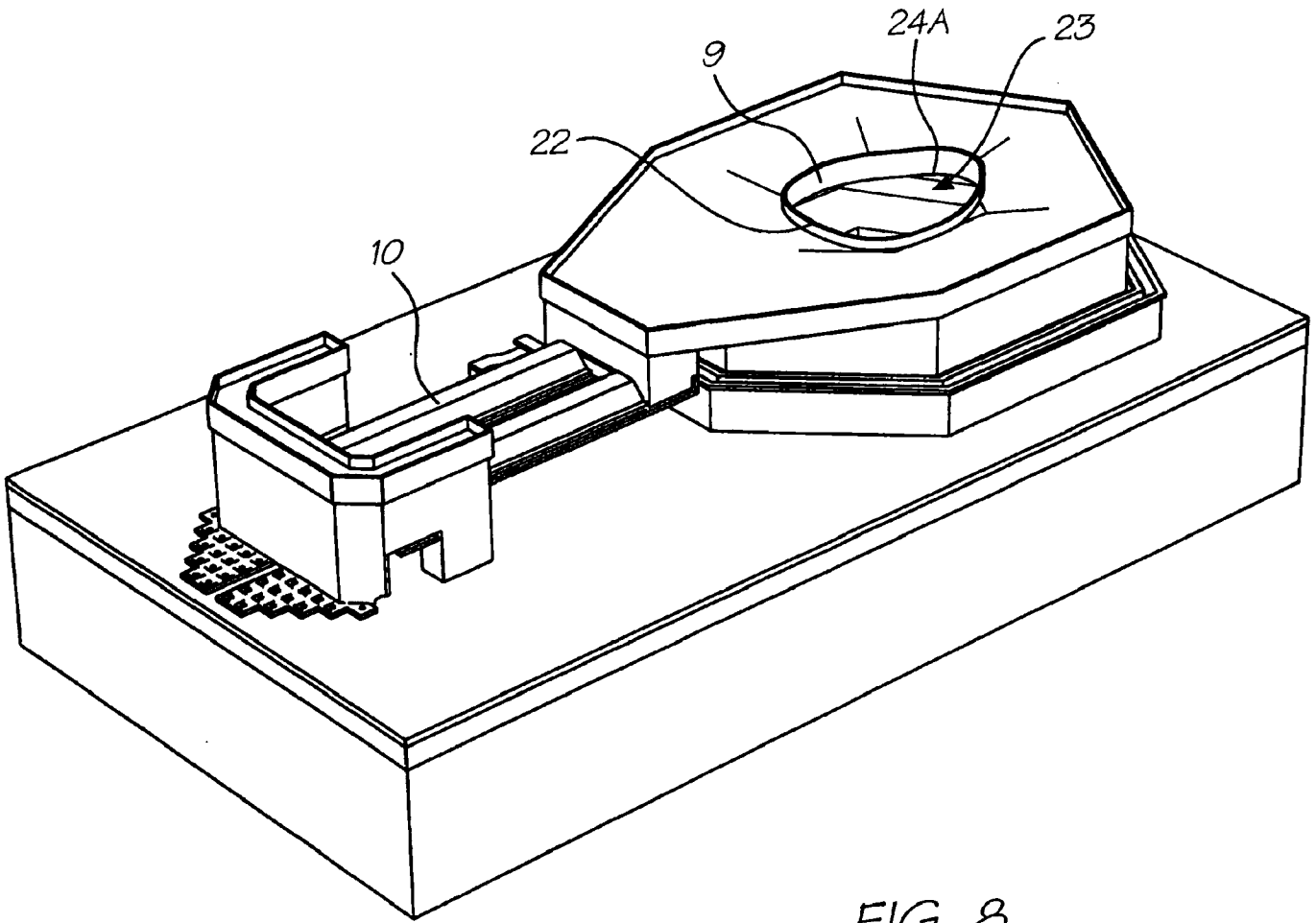
FIG. 8 is a three dimensional view of the nozzle arrangement of FIG. 1.

The correction of this non-perpendicular movement can be achieved by providing the nozzle rim 9 with an asymmetrical shape as can be clearly seen in FIG. 8. The nozzle is typically wider and flatter across the end 22 which is closer to the bend actuator 10, and is narrower and more pointed at end 23 which is further away from the bend actuator. This narrowing of the nozzle rim 9 at end 23 increases the force of the surface tension at the narrow part of the nozzle rim 9, resulting in a net drop vector force indicated by arrow 24A in the direction toward the bend actuator, as the drop is ejected from the nozzle. This net force propels the ink drop in a direction which is not perpendicular to the roof portion 6 and can therefore be tailored to compensate for the tilted orientation of the roof portion 6 at the point of ink drop ejection.

By carefully tailoring the shape and characteristics of the nozzle rim 9, it is possible to completely compensate for the tilting of the roof portion 6 during actuation and to propel the ink drop from the nozzle in a direction perpendicular to the floor portion 5.

Figure 9:
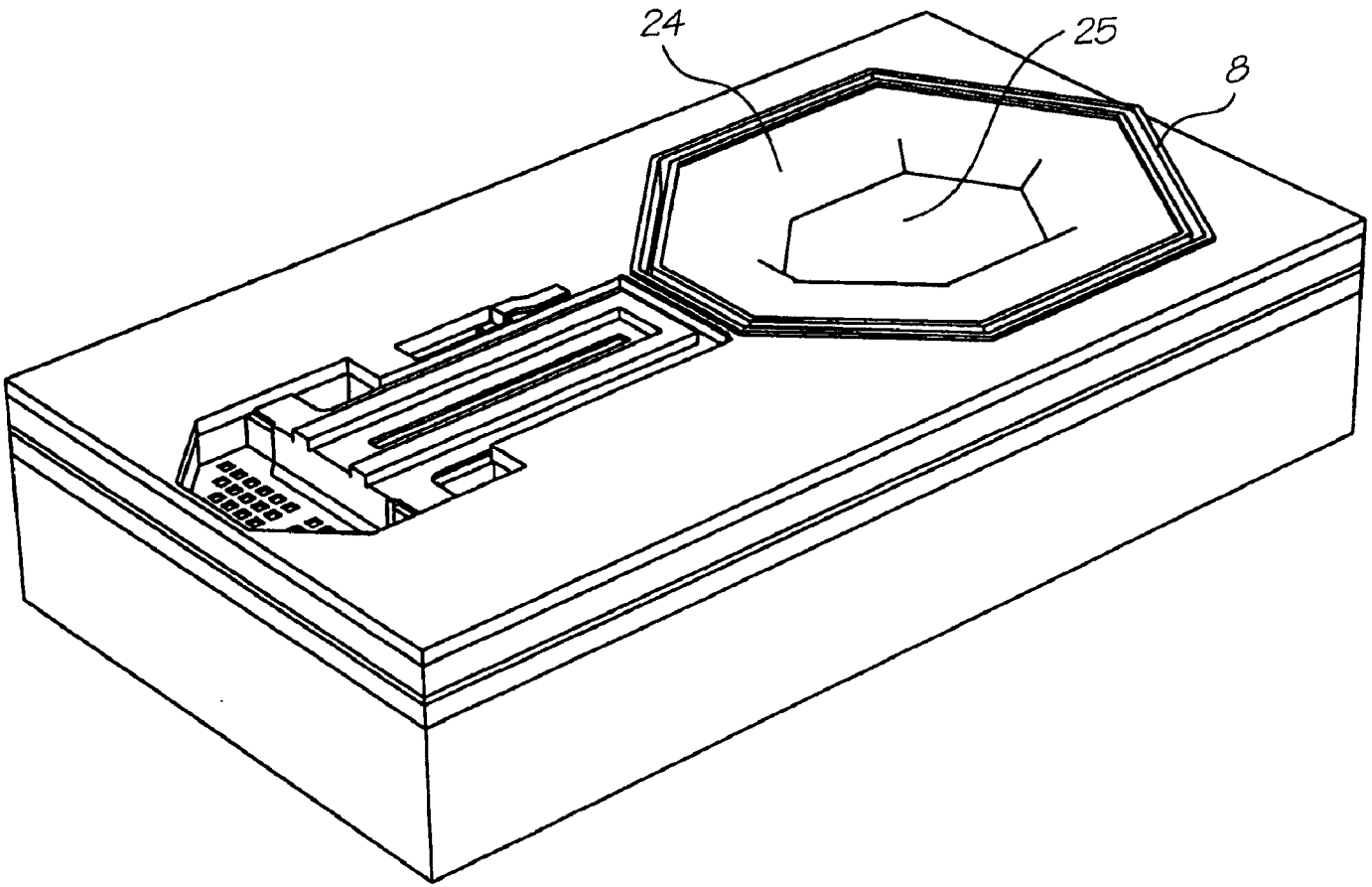
FIG. 9 is a similar view to FIG. 8 with part of the nozzle arrangement removed to show an optional constriction in the nozzle chamber.
Figure 10:
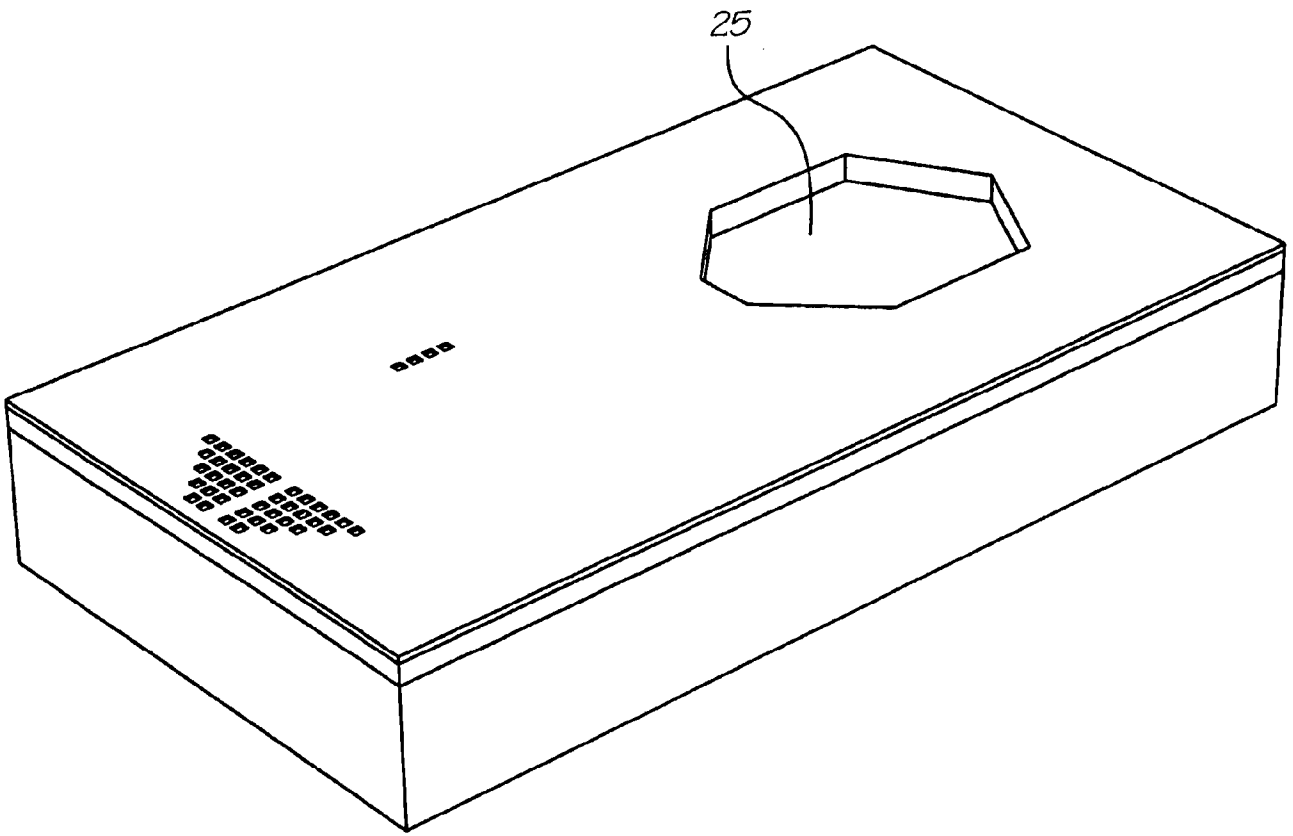
FIG. 10 is a similar view to FIG. 9 with upper layers removed.

Although, as described above, the backpressure to the ink held within the nozzle chamber may be provided by viscous drag in the supply conduits, it is also possible to provide a moving nozzle ink jet with backpressure by way of a significant constriction close to the nozzle. This constriction is typically provided in the substrate layers as can be clearly seen in FIGS. 9 and 10. FIG. 9 shows the sidewall 8 from which depend inwardly one or more baffle members 24 resulting in an opening 25 of restricted cross-section immediately below the nozzle chamber. The formation of this opening can be seen in FIG. 10 which has the upper layers (shown in FIG. 9) removed for clarity. This form of the invention can permit the adjacent location of ancillary components such as power traces and signal traces which are desirable in some configurations and intended use of the moving nozzle ink jet. Although the use of a restricted baffle in this manner has these advantages, it also results in a longer refill time for the nozzle chamber which may unduly restrict the speed of operation of the printer in some uses.

Figure 11:
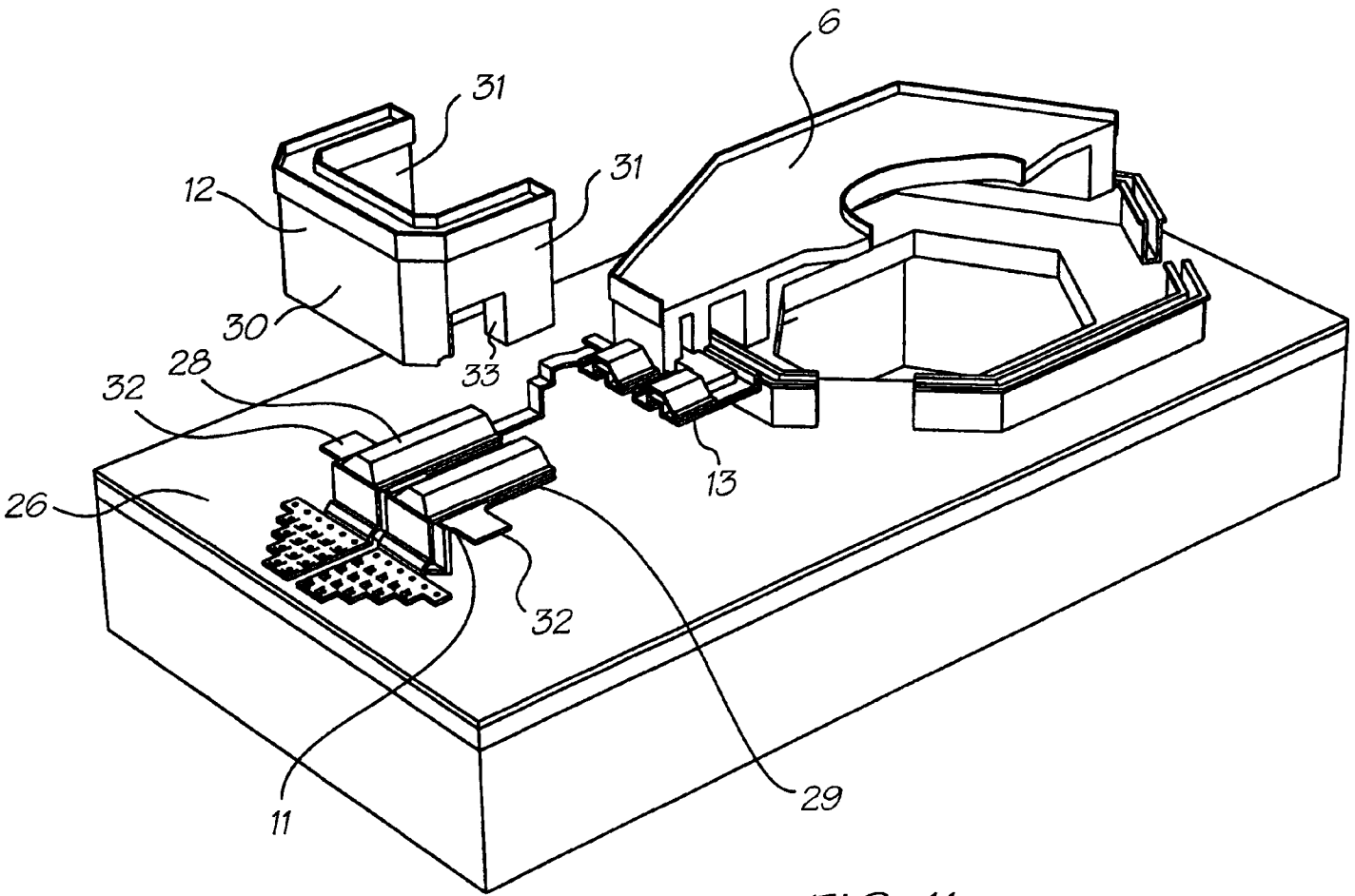
FIG. 11 is a similar view to FIG. 1 showing the bend actuator cut away, and the actuator anchor detached for clarity.

The bend actuator which is formed from a heated cantilever 28 positioned above a non-heated cantilever 29 joined at the distal end 13 needs to be securely anchored to prevent relative movement between the heated cantilever 28 and the non-heated cantilever 29 at the proximal end 11, while making provision for the supply of electric current into the heated cantilever 28. FIG. 11 shows the anchor 12 which is provided in a U-shaped configuration having a base portion 30 and side portions 31 each having their lower ends formed into, or embedded in the substrate 26. The formation of the bend actuator in a U-shape gives great rigidity to the end wall 30 preventing any bending or deformation of the end wall 30 relative to the substrate 26 on movement of the bend actuator.

The non-heated cantilever 29 is provided with outwardly extending tabs 32 which are located within recesses 33 in the sidewall 31, giving further rigidity, and preventing relative movement between the non-heated cantilever 29 and the heated cantilever 28 in the vicinity of the anchor 27.

In this manner, the proximal end of the bend actuator is securely and firmly anchored and any relative movement between the heated cantilever 28 and the non-heated cantilever 29 is prevented in the vicinity of the anchor. This results in enhanced efficiency of movement of the roof portion 6 of the nozzle arrangement.

What is claimed is:

1. An ink jet printhead that comprises a substrate; and a plurality of micro-electromechanical nozzle arrangements positioned on the substrate, each nozzle arrangement comprising a nozzle chamber defining structure positioned on the substrate and having a fixed portion that is fast with the substrate and a movable portion that is displaceable with respect to the substrate and that defines an ink ejection port, the movable portion and fixed portion together defining a nozzle chamber and the movable portion being displaceable towards and away from the substrate to reduce and subsequently increase a volume of the nozzle chamber so that ink is ejected from the ink ejection port; and an elongate actuator that is anchored to the substrate at one end and operatively engaged with the movable portion at an opposite end, the elongate actuator being bent relative to the substrate on receipt of an electrical signal to displace the movable portion with respect to the fixed portion, wherein the ink ejection port is shaped so that tilting of the movable portion results in the ejection of a drop of ink in a direction substantially at right angles to the substrate.

2. An ink jet printhead as claimed in claim 1, in which the ink ejection port is defined by a nozzle rim which has a suitable plan profile to impart said shape to the ink ejection port.

3. An ink jet printhead as claimed in claim 2, in which the nozzle rim is shaped to define a first side which is flatter and broader than an opposite second side, the first side being interposed between the second side and the actuator, such that surface tension effects across the ink ejection port are greater at the second side than at the first side.

4. An ink jet printhead as claimed in claim 1, in which the movable portion includes a roof wall and a sidewall depending from a periphery of the roof wall and the fixed portion includes a complementary sidewall, the sidewalls being configured to overlap when the movable portion is displaced towards the substrate.

5. An ink jet printhead as claimed in claim 1, in which the substrate defines a plurality of ink inlet channels, each ink inlet channel being in fluid communication with a respective nozzle chamber.

6. An ink jet printhead as claimed in claim 5, in which flow restriction members are positioned in an opening of each inlet conduit to restrict the flow of ink into the nozzle chamber, thereby to facilitate pressure development in the nozzle chamber as the movable portion is displaced towards the substrate.

* * * * *

UNITED STATES PATENT AND TRADEMARK OFFICE

CERTIFICATE OF CORRECTION

PATENT NO. : 6,994,425 B2
APPLICATION NO. : 10/893378
DATED : February 7, 2006
INVENTOR(S) : Kia Silverbrook It is certified that error appears in the above-identified patent and that said Letters Patent is hereby corrected as shown below:

"Related US Application Data" on the title page should read:

--(63) Continuation of application No. 10/303,347, filed on Nov. 23, 2002, now Pat. No. 6,767,077, which is a continuation of application on No. 09/693,313 filed Oct. 20, 2000, now Pat. No. 6,505,916.--

Column 1, lines 5 and 6 should read:

-- Continuation application on Ser. No. 10/303,347 filed on Nov. 23, 2002 now U.S. Pat. No. 6,767,077, which is a continuation application on Ser. No. 09/693,313 filed Oct. 20, 2000, now U.S. Pat. No. 6,505,916.--

Signed and Sealed this

Nineteenth Day of December, 2006

JON W. DUDAS
*Director of the United States Patent and Trademark Office*